United States Patent [19]

Biersach

[11] Patent Number: 4,554,531

[45] Date of Patent: Nov. 19, 1985

[54] OMNIDIRECTIONAL SIREN

[76] Inventor: James E. Biersach, 5231 W. Parkview Dr., Mequon, Wis. 53092

[21] Appl. No.: 453,702

[22] Filed: Dec. 27, 1982

[51] Int. Cl.[4] ..... G08B 3/00

[52] U.S. Cl. ..... 340/387; 340/390; 340/384 R; 179/115.5 H; 181/143

[58] Field of Search ..... 340/387, 390–391, 340/384 R, 404–406; 381/86–89, 56, 90; 179/115.5 H; 181/143, 149, 152, 153

[56] References Cited

U.S. PATENT DOCUMENTS

| | | | |
|---|---|---|---|
| 1,332,322 | 3/1920 | Cole | 340/390 |
| 1,417,983 | 5/1922 | Freeble | 340/390 |
| 1,761,162 | 6/1928 | Volf | 340/405 |
| 2,198,026 | 4/1940 | Farmer | 340/388 |
| 2,203,715 | 6/1940 | Benecke | 381/89 |
| 3,454,729 | 9/1965 | Seebinger | 179/115.5 H |
| 3,797,606 | 3/1974 | Edwards | 181/143 |
| 3,888,333 | 6/1975 | Yamaguchi | 181/143 |

*Primary Examiner*—John W. Caldwell, Sr.

*Assistant Examiner*—Tyrone Queen

*Attorney, Agent, or Firm*—James E. Nilles

[57] ABSTRACT

The stator of the sound generator in the siren of this invention is mounted on struts that diverge upwardly from the top of an upright post, with its axis coinciding with that of the post. The coaxial rotor of the sound generator is driven by a motor mounted on top of the stator. Sound from the generator is concentrated and directed by a horn that flares along its length from a closed end portion to a mouth. The closed end portion is dome-like and concentrically surrounds and covers the sound generator, opening unrestrictedly downwardly into a bottom portion of the horn that curves along its length so that the mouth, which is wholly spaced below the sound generator, opens to one side of the post. The post extends through a bottom wall portion of the horn. Rollers supported by the stator engage a downwardly facing annular track surface in the closed end portion of the horn to support the horn for rotation, one roller being rotatably driven from the siren motor to rotate the horn during siren operation.

7 Claims, 4 Drawing Figures

OMNIDIRECTIONAL SIREN

FIELD OF THE INVENTION

This invention relates to sirens such as are used for community fire alarms, air raid warnings and severe weather alerts; and the invention is more particularly concerned with a siren that comprises a sound generator and a horn and wherein the horn is so configured and arranged that it prevents rain, snow and the like from entering the sound generator and thus prevents ice formation that could disable the siren.

BACKGROUND OF THE PRIOR ART

A siren of the general type to which the present invention relates is mounted at a fixed location, often on top of a building or on a tower, so that its sound output will be heard at substantial distances. In most cases it must be omnidirectional, that is, it must emit sound substantially uniformly in all directions so that it can be heard in all parts of a community that it serves.

In general, a siren of the type here under consideration comprises a sound generator consisting of a radially apertured rotor or so-called chopper that is concentrically rotatable in a radially apertured casing or stator. The rotor, which is usually driven by an electric motor, serves, in effect, as a pump that draws in air and pressurizes it. As the rotor turns, its apertures move through transient register with the apertures in the stator to permit intermittent escape of the pressurized air for sound generation.

Associated with the sound generator is a sound directing means which prevents the sound energy from being dispersed upwardly. This may take the form of a system of louvers around the sound generator, or, as is more common, the sound generator may be mounted in a closed end portion of a lengthwise flaring horn or megaphone that concentrates the sound energy into a more or less directional beam. When a siren comprising a horn is required to produce an omnidirectional signal, the horn is usually caused to rotate about a vertical axis during operation of the siren, at a rate on the order of a few revolutions per minute. Heretofore an omnidirectional siren comprising a rotating horn has almost invariably had a collector ring connection through which its motor was energized, to accommodate rotation of the horn. Such a connection was not completely dependable, because wear and accumulations of foreign matter could break the energizing circuit.

A more serious problem, heretofore encountered with sirens installed in cold weather climates, has been lock-up of the siren by ice frozen between the stator and the rotor of the sound generator. Almost all prior sirens have been so arranged that rain, snow or sleet could enter the sound generator, either being blown directly into it by the wind or being drawn into it through its air inlet when the siren was operated during inclement weather. Although snow or sleet, as such, would not materially interfere with operation of the siren, such frozen precipitate could be melted in the sound generator as a result of air compression that heated the device during siren operation. Thus, moisture that entered the sound generator in any form could freeze during cold weather and form a solid bridge between the stator and the rotor whereby the latter was locked against rotation.

Sirens have been known and used in emergency warning systems for decades, but the above explained problem of freeze-up has persisted without a satisfactory solution. Everyone concerned with the art has certainly recognized that a siren, as an emergency warning device, must be absolutely reliable under all conditions. It is evident, therefore, that something beyond mere skill in the art has been needed for satisfactory solution of the problem.

Two prior patents have disclosed arrangements that were intended to prevent weather related failures of sound-signal warning devices, but each of them was markedly unsatisfactory in certain respects.

U.S. Pat. No. 1,323,826, issued to O. S. Burke in 1919, disclosed a siren having a dome-shaped or approximately spherical housing which surrounded the sound generator with a rather large clearance and which was mounted on a base plate for rotation about a vertical axis. The housing had a relatively small concentric opening in its top through which its interior was communicated with the narrow end of a horn that was fixed to the housing and extended upwardly a short distance from it, then curved around to project laterally a substantial distance to one side of the housing axis. Vanes on the inside of the housing were arranged to be acted upon by air discharged from the sound generator for rotating the housing about its axis, to thus swing the horn around in a circle. Because the housing necessarily converged towards its top outlet to provide for such air-driven rotation, the acoustic efficiency of the arrangement was very low. Furthermore, the vanes on the inside of the housing, acted upon by air expelled from the sound generator, provided a somewhat impositive drive for horn rotation whereby the weathervane effect of the wind on the long, laterally extending horn could cause the horn to turn at a rate that varied markedly from point to point around its orbit, or could prevent it from rotating if the wind were strong enough. Furthermore, there was a possibility of the sound generator overheating because air discharged from it tended to be recirculated back to its inlet by the dome-like shape and the restricted top outlet of the housing.

U.S. Pat. No. 2,198,026, issued to C. C. Farmer in 1940, disclosed a locomotive steam whistle that was rotatable through around an upright axis. The whistle comprised a horizontally extending horn having a sound generator mounted at its small diameter end. In its normal position the mouth of the horn opened rearwardly, to prevent accumulations of snow, dirt and the like from being driven into the horn by forward movement of the locomotive and to direct signals to train crew members in the caboose. For forwardly projected signals the horn was swung around to its opposite position by a pressure responsive actuating device operating under the control of solenoid valves connected with a selector switch in the locomotive cab. The patent evidenced recognition of the problem posed by an intrusion of foreign matter into a device that produces a sound signal, although the arrangement that it disclosed was obviously unsuitable for an omnidirectional community warning siren.

SUMMARY OF THE INVENTION

The general object of the present invention is to provide an omnidirectional siren which is intended to be mounted at a fixed location and which is substantially immune to the effects of rain, snow and the like inasmuch as its sound generator is protectively housed within the closed end portion of its horn and the horn is so configured as to prevent precipitation from being blown or drawn into the sound generator.

It is also a general object of this invention to provide a siren which achieves the objects just stated and which comprises a rotatable horn that is positively driven for rotation at a steady rate, said horn being so configured as to produce substantially negligible weathervaning effect even in high winds and therefore requiring little power to drive it in rotation.

A more specific object of the invention is to provide a siren of the character described wherein the drive means for rotating the horn is enclosed within the horn itself, along with the sound generator, so that the horn completely shelters these parts of the siren from precipitation, and wherein electric current is supplied to the motor or motors for sound generation and for horn rotation through fixed electrical connections rather than through collector rings or the like.

It is also a specific object of the invention to provide a siren of the character described wherein the bearings that mount the horn for rotation are also protectively sheltered by the horn itself.

A further object of the invention is to provide a siren of the above described character which is inexpensive, light in weight, and readily assembled and disassembled, and which, in addition, presents relatively low drag to wind from any direction so as to be well adapted for mounting on a relatively light and inexpensive tower structure.

In general, these and other objects of the invention that will appear as the description proceeds are achieved in a siren of the type comprising a sound generator that has a stator and a coaxial motor-driven rotor, and a horn which flares along its length from a closed end portion surrounding the sound generator to a substantially wide mouth from which sound issues. The siren of this invention is characterized by stator supporting means on an upper portion of an upright post whereby the stator of the sound generator is secured in fixed coaxial relation to the post. The closed end portion of the horn is substantially dome-like and is in covering and coaxially surrounding relation to the sound generator. The horn has a lower portion into which said closed end portion opens unrestrictedly downwardly and which, along its length, is curved downwardly and to one side of the post; and said lower portion defines a mouth that is wholly spaced below the sound generator and opens radially to said one side of the post, and it has a bottom wall portion wherein there is an aperture through which the post extends. The horn is confined to rotation about said axis and is rotatably driven, at times when the sound generator is operating, by supporting and drive means enclosed within the closed end portion of the horn and engaging a downwardly facing surface therein. The air intake in the sound generator is at its bottom, and a motor for driving its rotor is coaxially mounted on top of its stator, within the closed end portion of the horn.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 2:
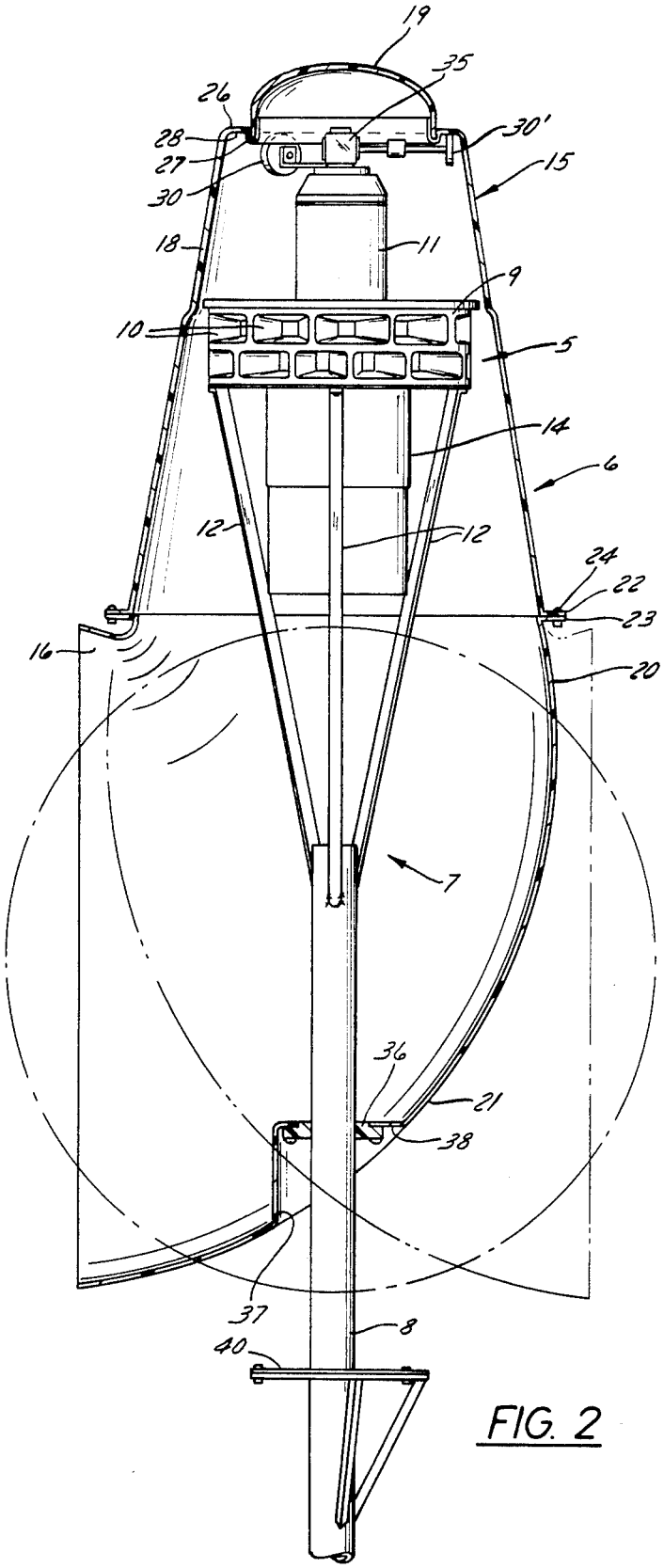
FIG. 2 is a view of the siren with the horn shown in vertical section and other parts shown in side elevation.
Figure 1:
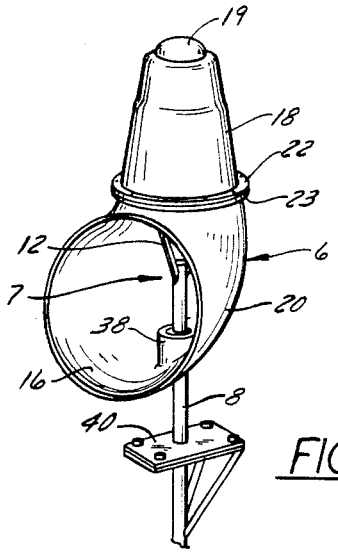
FIG. 1 is a perspective view of a siren of this invention.
Figure 3:
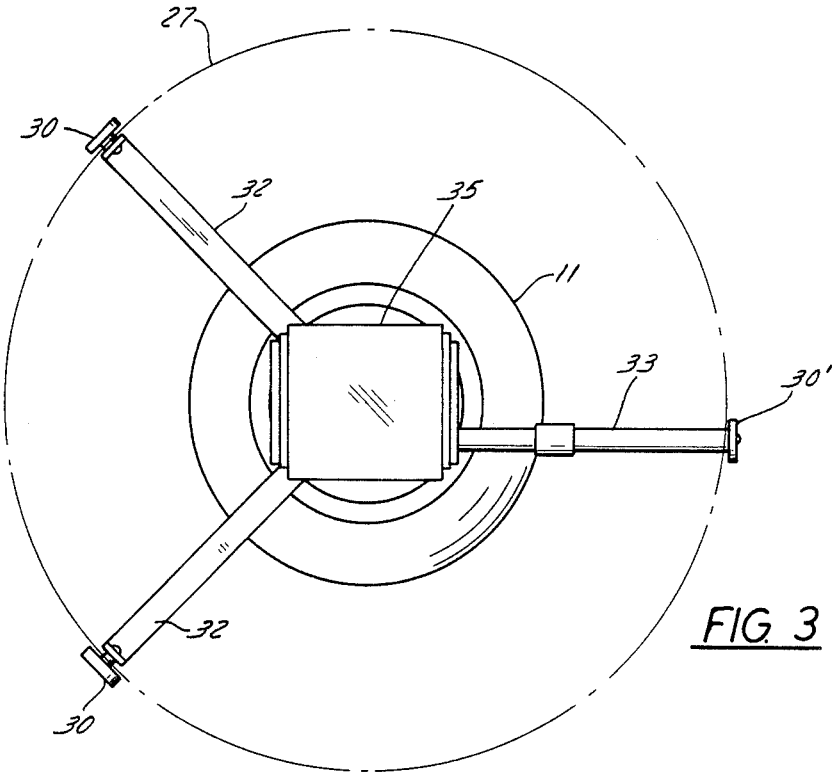
FIG. 3 is a view looking downward on the siren with its horn removed.
Figure 4:
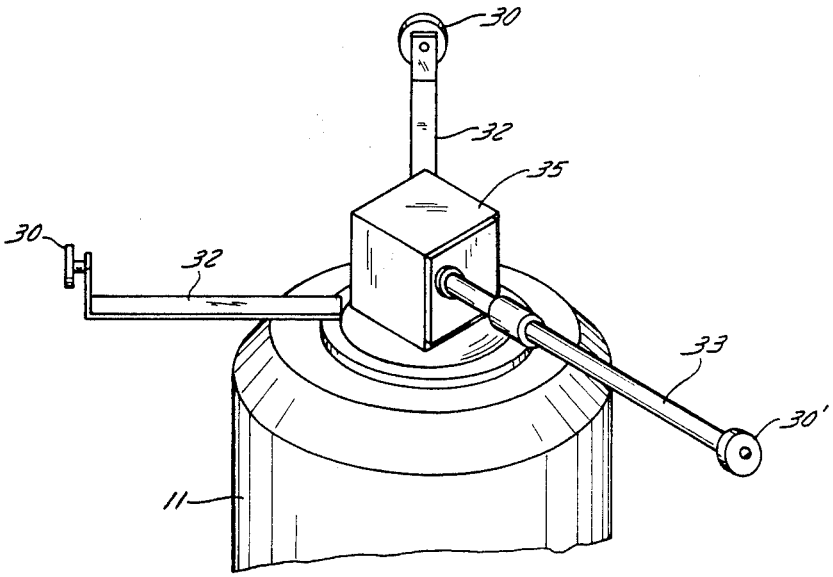
FIG. 4 is a perspective view of the upper portion of the siren motor and the means for rotatably supporting the horn and for driving it in rotation.

A siren embodying the principles of this invention comprises, in general, a sound generator 5 and a cooperating horn or megaphone 6, both carried by supporting means 7 comprising an upright post 8.

The sound generator 5 is generally conventional and is therefore not shown in detail. It comprises a siren stator 9 in the form of an annular casing in which there are radially outwardly opening outlets 10 and in which a siren rotor (not shown) is concentrically rotatable. The siren rotor is driven by an electric motor 11 that is mounted on the siren stator 9 with its shaft concentric to the siren stator axis. In this case the axis of the stator 9 is vertical and coincides with the axis of the post 8, and the motor 11 is mounted on top of the siren stator. The siren stator, in turn, is supported on upwardly divergent struts 12 which project up from the post 8 and comprise a part of the supporting means 7. Between the struts, projecting concentrically downwardly from the stator, is a cylindrical tubular air intake 14 which serves as a resonator that tunes the siren. Inside the air intake 14 there may be a known valve-like device (not shown) which can be cycled during siren operation for a characteristically varying output or can remain inoperative for a steady output, depending upon the nature of the warning to be signalled by the siren.

The horn 6 serves to concentrate the sound energy from the sound generator 5 for emission as a more or less directional beam, and it rotates when the siren is operating to provide for omnidirectional emission of the sound. As is generally conventional, the horn 6 has a closed end portion 15 in which the sound generator is located and from which the horn flares or diverges along its length to a relatively wide mouth 16 from which the sound issues. In this case the closed end portion 15 of the horn is dome-like, and its axis is concentric to the post 8 and is thus also concentric to the siren stator 9 and the motor 11 of the sound generator.

As here shown, the horn 6 is made in three parts, each of which is preferably of plastic impregnated fiberglass, for lightness and strength. One of these is a substantially frustoconical middle member 18 that coaxially surrounds the motor 11 and the sound generator, including both the upper portion of the siren stator 9 having the outlets 10 and the tubular air inlet 14. Cooperating with the middle member 18 to define the closed end portion 15 of the horn is a cap member 19 which is seated upon the top of the middle member and closes the opening in its upper end. The third part of the horn is a bottom member 20 which defines the mouth 16 of the horn and which is curved along its length so that the mouth 16 is disposed wholly to one side of the post 8 and opens radially to that side of the post. Because the lower horn member 20 is arcuately curved along its length as well as substantially circular in cross-section, it has a bottom wall portion 21 that is curved more or less as a spherical segment, and the post 8 extends through that bottom wall portion as explained below. For connecting the bottom member 20 to the middle member 18, the latter has a radially outwardly projecting circumferential flange 22 around its bottom edge that abuttingly engages an opposing circumferential flange 23 on the upper edge of the bottom member, and the two flanges are fastened together by bolts 24.

At its top the middle member 18 has a relatively wide radially inwardly projecting circumferential flange 26, the inner edge of which terminates at a lip 27 that is reversely curved to project both downwardly and upwardly. The downwardly projecting portion of the lip 27 cooperates with the bottom surface of the circumferential flange 26 to define an annular roller track 28, and the cap 19 engages around the upwardly projecting portion of the lip, with which it can have a snap fit or to which it can be cemented or otherwise bonded.

The horn 6 is supported for rotation about its axis by means of rollers 30 that engage the annular track 28 at circumferentially spaced locations around it. As shown, there are three such rollers 30 (there could of course be more of them), two of these being idlers that are journalled on the outer ends of radially outwardly projecting supporting arms 32, and the third roller 30' being a drive roller which imparts rotation to the horn when the siren is operating. The supporting arms 32 for the idler rollers 30 are secured at their inner end portions to the housing of the siren motor 11 or are otherwise fastened to the stator 9 of the sound generator. The drive roller 30', which has a friction surface at its periphery, is secured to the outer end of a radially extending drive shaft 33 that is confined to rotation.

The horn could obviously be driven for rotation by means of a separate horn motor mcunted on top of the siren motor 11, but it is preferred to employ the siren motor for horn rotation, as here shown. As is conventional, the shaft of the siren motor has one end portion (not shown) to which the rotor of the sound generator is directly secured and which in this case projects downwardly from the motor housing, but in this case the siren motor shaft also has an upwardly projecting end portion, received in a gear box 35 which is mounted on top of the siren motor housing and through which the motor shaft is drivingly connected with the radially projecting drive shaft 33. The horn therefore rotates whenever the siren motor is operating.

Because the track 28 that is engaged by the rollers 30 is bounded at its inner edge by the lip 27 and at its outer edge by the side wall of the middle horn member 18, the rollers 30 cooperate with that track to confine the horn to rotation about its axis while they support it for such rotation. It will be observed that the rollers 30 are completely sheltered from the weather elements. The horn is steadied against wobbling by a bearing 36 that is connected between the post 8 and the sperical-segment bottom wall portion 21. The bearing 36 comprises a flat ring of nylon or the like through which the post 8 extends with a close but rotatable fit. The bottom wall portion 21 of the horn is formed with a recess or bay 37 that defines a horizontal wall portion 38 in which there is a hole somewhat larger than the diameter of the post, and the bearing ring 36 flatwise underlies this horizontal wall portion 38 and is secured to it as by means of bolts.

In assembling the siren, the bearing 36 and the bottom member 20 of the horn are first slipped over the upper end portion of the post 8, and then the struts 12 are secured to the top portion of the post, preferably by welding. The stator 9 of the sound generator is bolted to radially outwardly projecting pads on the upper ends of the struts 12. The motor 11, the gear box 35 and the fixed arms 32 for the idler rollers can then be installed on the stator 9 if they were not already assembled to it when the stator was fastened to the struts 12. The middle member 18 of the horn and the cap member 19 can then be set in place. Thereafter the bottom member 20 of the horn can be lifted up to bring its flange 23 into abutting relationship to the bottom flange 22 on the middle horn member, and these two flanges can be bolted together. The bearing 36 can then be raised up along the post 8 into flatwise engagement with the horizontal wall portion 38 on the bottom horn member and secured to it.

To prevent the bearing 36 and the bottom horn member 20 from sliding down to the bottom of the post 8 during assembly of the siren and any subsequent disassembly of it, a small platform 40 is fixed to the post at a level a little below the bottom of the assembled horn.

Since the horn has a progressively increasing diameter from its upper end to its mouth, so that its closed upper end portion opens unrestrictedly downwardly into its lower portion, the horn has good acoustical properties and permits free flow of air to and from the sound generator. The mouth of the horn is wholly located below the level of the sound generator, including its air inlet 14, and therefore precipitation can neither be drawn nor blown into the sound generator.

From the foregoing description taken with the accompanying drawings it will be apparent that this invention provides an omnidirectional siren having a sound generator and a rotatable horn, wherein the horn is so arranged as to shelter the sound generator as well as the means for rotatably driving the horn, and wherein the motor or motors for sound generation and for horn rotation are energized through fixed electrical connections rather than through collector rings or the like. The critical parts of the siren are therefore not affected by precipitation or other foreign matter, and consequently the siren is reliable under all weather conditions. It will also be apparent that the siren of this invention, in addition to being simple and inexpensive in itself, is light in weight and produces low wind moments so as to be well adapted for mounting on a light and inexpensive supporting structure.

What is claimed as the invention is:

1. A siren of the type comprising an elongated horn which has a closed end and which flares along its length from said closed end to a wide mouth at its opposite end, a sound generator in the closed end portion of said horn comprising an annular siren stator having an axis, an inlet, radially outwardly opening outlets and a siren rotor in said siren stator rotatable on said axis to draw air through said inlet and intermittently expel it through said outlets to generate sound energy that is concentrated by said horn and is emitted from the mouth thereof, and a motor by which the siren rotor is rotatably driven, said siren being characterized by:

A. an upright post;

B. stator supporting means on an upper portion of said post securing the siren stator in fixed coaxial relation to the post;

C. said motor being mounted on top of the siren stator;

D. said inlet being at the bottom of the siren stator;

E. the closed end portion of said horn comprising (1) a frustoconical downwardly flaring portion surrounding said motor and coaxially surrounding the siren stator in radially spaced relation thereto and (2) a dome-like portion extending across and closing the upper end of said frustoconical portion, said closed end portion having in its interior a downwardly facing annular surface concentric to said axis;

F. the horn having a lower portion into which said frustoconical portion opens unrestrictedly downwardly and which curves downwardly and to one side of said post from said frustoconical portion, said lower portion (1) defining a mouth that is wholly spaced below the sound generator and opens radially to said one side of the post and (2) having a bottom wall portion wherein there is an aperture through which the post extends; and G. horn supporting and drive means enclosed within the closed end portion of the horn and engaging said annular surface (1) for supporting the horn and confining it to rotation about said axis and the post and (2) for driving the horn for such rotation.

2. The siren of claim 1, further characterized by:

F. a bearing surrounding said post and connected with said bottom wall portion of the horn to cooperate with the post and with said horn supporting and drive means in confining the horn to rotation about said axis.

3. The siren of claim 1, further characterized by said horn supporting and drive means comprising:

(1) a plurality of rollers, and (2) means carried by the siren stator supporting said rollers at fixed locations that are spaced circumferentially around said downwardly facing annular surface and with the axes of the respective rollers substantially radial to said axis of the siren stator so that the rollers rollingly engage and support said surface.

4. The siren of claim 3 wherein at least one of said rollers is rotatably driven and frictionally engages said surface to drive the horn for rotation.

5. The siren of claim 1 wherein said stator supporting means comprises a plurality of struts secured to the upper portion of the post and projecting divergingly above the same, said struts having their upper ends secured to the stator at circumferentially spaced locations thereon.

6. The siren of claim 4 wherein said at least one roller is rotatably driven from said motor.

7. The siren of claim 1 wherein said inlet comprises a cylindrical tube which projects downward from the siren stator, concentrically to said axis thereof, and which serves as a resonator.

* * * * *